US005628416A

United States Patent [19]

Frommelt et al.

[11] Patent Number: 5,628,416

[45] Date of Patent: May 13, 1997

[54] TRAVELING CRANE WITH TELESCOPING BOOM

[75] Inventors: Uwe Frommelt, Ehingen; Hans-Dieter Willim, Unterweiler, both of Germany

[73] Assignee: Liebherr-Werk Ehingen, Ehingen, Germany

[21] Appl. No.: 365,469

[22] Filed: Dec. 28, 1994

[30] Foreign Application Priority Data

Dec. 28, 1993 [DE] Germany ..... 43 44 795.3

[51] Int. Cl.[6] ..... B66C 23/70

[52] U.S. Cl. ..... 212/292; 212/349

[58] Field of Search ..... 212/292, 348, 212/349, 230, 231; 187/394

[56] References Cited

U.S. PATENT DOCUMENTS

| | | | |
|---|---|---|---|
| 3,658,189 | 4/1972 | Brown et al. | 212/349 |
| 3,743,056 | 7/1973 | Zitelli et al. | 187/394 |
| 4,036,372 | 7/1977 | Rao et al. | 212/292 |
| 4,327,533 | 5/1982 | Sterner | 212/348 |

FOREIGN PATENT DOCUMENTS

| | | |
|---|---|---|
| 0476225A2 | 3/1992 | European Pat. Off. . |
| 0499208A2 | 8/1992 | European Pat. Off. . |

*Primary Examiner*—Thomas J. Brahan
*Attorney, Agent, or Firm*—Jacobson, Price, Holman & Stern, PLLC

[57] ABSTRACT

A traveling crane including a telescoping boom whose individual telescopically extending boom members are able to be extended and retracted after the disengagement of locking bolt connections using one single stage hydraulic piston and cylinder unit. The boom members are bolted in the respective extended or retracted positions by locking bolts spring-loaded toward the locked setting thereof. The piston rod of the piston and cylinder unit is pivotally attached to the boom joint member terminating the inner end of the outer boom member. An entraining device, which is able to be coupled with a receiving member on the telescopically extending boom members, is arranged in a part of the end of the cylinder, from which the piston rod comes out of the cylinder. Each of the telescoping boom members is provided at its inner end with at least one locking bolt, which is urged by a spring in a radial extension direction to lock in a hole provided at the inner end or adjacent to the outer end of the boom member encompassing such boom member. At an outer end thereof the locking bolt possesses a coupling member, which in the locking position of the locking bolt is coupled with the piston or piston rod of a hydraulic piston and cylinder unit arranged radially on the piston rod end of the cylinder. A drive is provided, which moves the cylinder accurately into the coupling position.

8 Claims, 3 Drawing Sheets

TRAVELING CRANE WITH TELESCOPING BOOM

FIELD OF THE INVENTION

The invention relates to a traveling crane with a telescoping boom whose individual telescoping members are adapted to be extended and retracted after disengagement of locking bolt connections using one single stage hydraulic piston and cylinder unit. The telescoping members are locked in a respective position of extension or retraction by locking bolts which are spring-loaded into their locking positions, in the case of which the piston rod of the piston and cylinder unit is pivotally joined to the boom joint member, which terminates the inner end of the outer boom member, and an entraining device, which is able to be coupled with receiving means of the telescoping members, is arranged adjacent to the piston rod end of the cylinder.

BACKGROUND OF THE INVENTION

In the case of a crane disclosed in European patent publication 0 476 225 A2, the outer boom member and furthermore the outwardly telescoping members possess spring-loaded locking bolts on their outer end on opposite sides, spaced symmetrically with respect to the luffing (lifting) plane, such bolts fitting into holes in the members encompassed by the bolts and being able to be moved out from the locking holes against a spring force by pneumatic bolting cylinders. The bolts can be locked in the locking holes by letting off of air.

In the known crane, supply lines must be laid in the individual boom members of the telescoping boom which are able to be extended and retracted in order to be able to get compressed air to the bolting cylinders. The arrangement of supply lines in the telescoping boom is not only intricate, but furthermore renders necessary the provision of large intermediate spaces between the individual boom members or telescoping boom members so that the telescoping boom members are generally not able to correspond to the full cross section of the boom members encompassing them, and must be designed with correspondingly smaller cross sections.

SUMMARY OF THE INVENTION

One object of the invention is therefore to provide a crane of the type initially mentioned in the case of which bolting cylinders for the individual boom members together with their plurality of pneumatic supply lines become unnecessary.

In order to achieve this object in the case of a crane of the type initially mentioned, each of the telescoping boom members is provided at its inner end with at least one locking bolt, which by means of a spring is urged in the direction of outward or radial extension into a hole provided at the inner end or adjacent to the outer end of the boom member surrounding the boom member in question dependent upon extension or retraction of the boom member. The locking bolt at its inner end is provided with a coupling member which (in the locking setting of the locking bolt) is able to be coupled with a piston or a piston rod of a hydraulic piston and cylinder unit arranged radially emanating from the piston rod end of the cylinder of the piston and cylinder unit. Furthermore, means are provided which are adapted to move the cylinder exactly into the coupling position.

In the case of the telescoping crane of the invention, the individual telescoping boom members are only provided at their inner ends with radially moving, spring-loaded locking bolts. The locking bolts may all be actuated with a common piston and cylinder unit arranged on the extending and retracting cylinder so that it is no longer necessary to have bolting cylinders or actuating devices for the locking bolts for each respective boom member.

It is convenient if each telescoping, extensible boom member is provided with only one locking bolt. The respective extension or retraction holes being located in the top part of the section material of the encompassing boom member in a horizontal position thereof.

In accordance with a further development of the invention there is the provision that the coupling members of all locking bolts consist of circular disks, which are connected by means of shanks with the locking bolts and are located in a common axial plane of the boom. The mating coupling member of the radial piston and cylinder unit is a piece of section material extending in the axial direction of the boom and has a trough-like portion with a U-shaped cross section. At the free ends of the limbs of the U-shaped cross section is provided inwardly directed ribs. The ribs define a gap between them, whose width is the same as the diameter of the shank. Furthermore the limbs have a clearance distance between them which is the same as the diameter of the disks. In this design the individual locking bolts may be coupled with the piston and cylinder unit actuating same by moving the piston and cylinder unit to be in coupling engagement with the coupling bolt, the coupling action being produced by moving the trough-like portion over the coupling disk.

Another advantageous feature of the invention is such that the radial piston and cylinder unit can only be operated for retraction of the locking bolt with the entraining device coupled with the boom member telescoped inwardly and outwardly. It is in this manner that the individual telescoping boom members are not at any time in an unlocked condition.

Preferably the receiving means take the form of holes or openings for receiving inwardly movable locking bolts. The entraining device comprises a block with oppositely arranged cylinders for the bolts able to be extended and retracted, and constituted by the pistons or the piston rods thereof.

In keeping with yet another possible form of the invention the holes take the form of slots extending in the axial direction of the crane and the locking bolts have encircling collars or beads at their outer ends. Since the locking bolts bear against the ends of the slots, the collars or beads extend over the sides of the slot, there is an additional way of preventing accidental disengagement of the bolt.

The means positioning the cylinder preferably comprise reflecting photoelectric detectors, with scan marks provided on the boom members to ensure correct positioning of the cylinder.

Preferably the boom members comprise section material, whose top side is constituted by U-like members, whose limbs are welded to the edges of lower semi-round or semi-oval shells. Such section material for the individual boom members of a telescoping boom are disclosed in European patent publication 499 208 A2.

The telescoping crane in accordance with the invention is characterized by a very simple and safe manner of construction. All limit switches and all electrical and hydraulic components are located on the telescoping cylinder. In order to lock the individual telescoping boom members it is unnecessary to provide any special power supply. Accordingly there are no power supply lines, so-called "energy supply chains", switch cabinets and other equipment belonging thereto.

Owing to the fact that the locking action is produced at the inner ends of the telescoping boom members, all locking devices are located on the end members and may be welded or incorporated in one single device.

Since no energy supply lines, such as for instance corrugated flexible cable sheaths, are required, the cross sections of the individual telescoping boom members may more completely fill the boom members enclosing them so that there is a better load carrying capacity and reduced flexure of the boom.

These and other objects of the invention, as well as many of the intended advantages thereof, will become more readily apparent when reference is made to the following description taken in conjunction with the accompanying drawings.

BRIEF DESCRIPTION OF THE DRAWINGS

One embodiment of the invention will now be described with reference to the drawings in more detail.

DETAILED DESCRIPTION OF THE PREFERRED EMBODIMENTS

Figure 1:
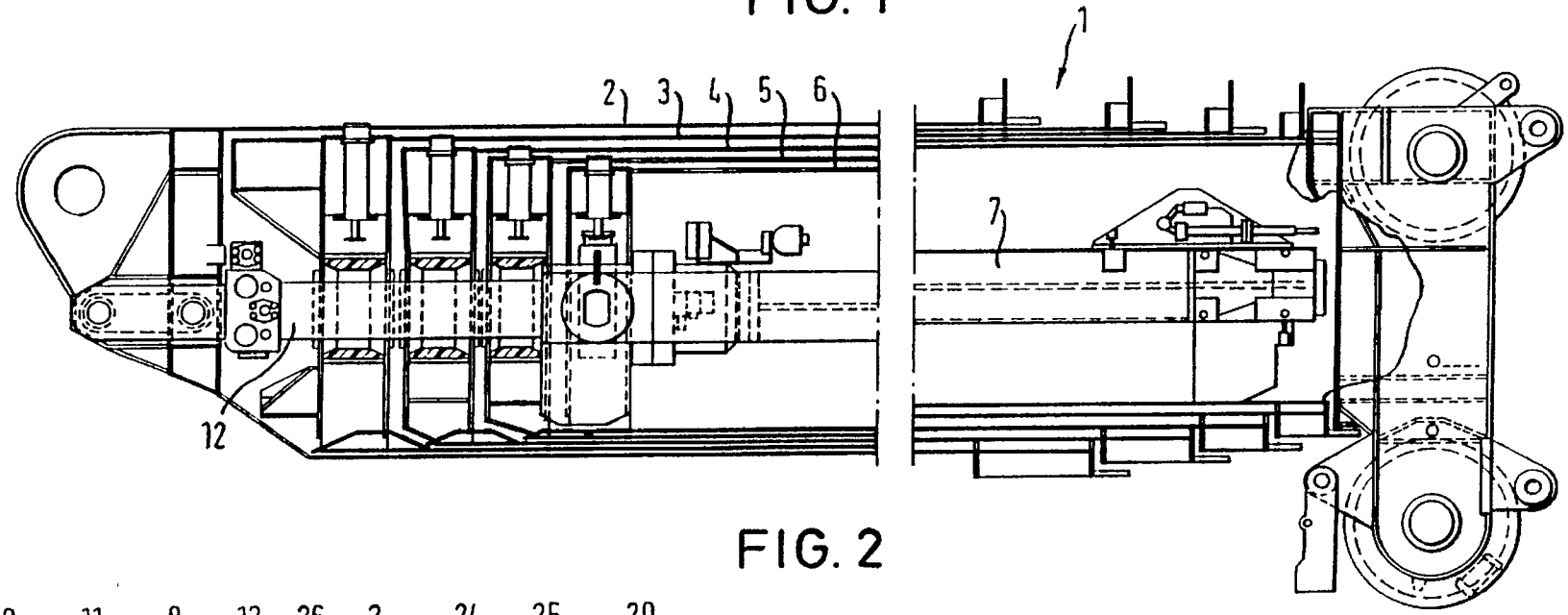
FIG. 1 is a longitudinal section taken through a telescoping boom with four telescoping boom members in the retracted condition.

In describing a preferred embodiment of the invention illustrated in the drawings, specific terminology will be resorted to for the sake of clarity. However, the invention is not intended to be limited to the specific terms so selected, and it is to be understood that each specific term includes all technical equivalents which operate in a similar manner to accomplish a similar purpose.

Figure 2:
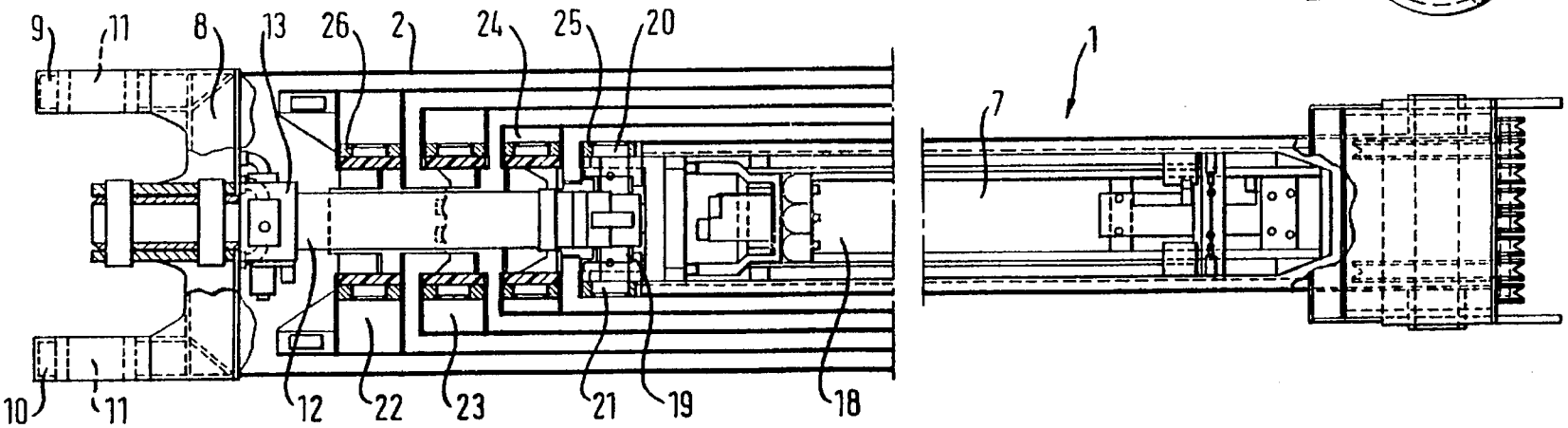
FIG. 2 is a horizontal section taken through the telescoping boom in accordance with FIG. 1.
Figure 3:
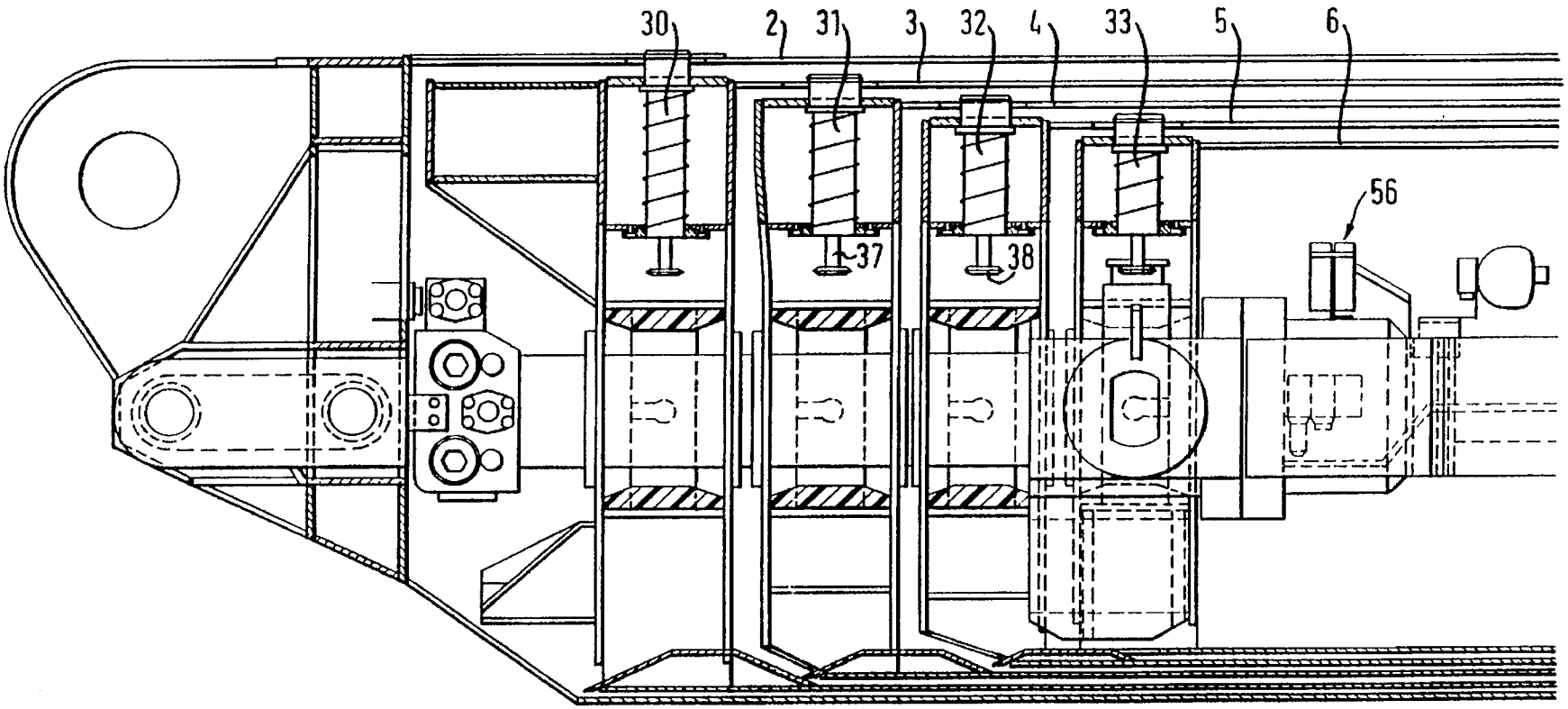
FIG. 3 shows the left hand part of the telescoping boom in accordance with FIG. 1, on a larger scale.

In FIGS. 1 through 3, a telescoping boom 1 is shown with an outer boom member 2, from which nested telescoping boom members 3, 4, 5 and 6 may be extended. In order to extend and to retract the individual telescoping boom members 3 through 6 there is a single stage piston and cylinder unit 7.

The outer boom member 2 has its inner end terminated by a boom joint member 8. This boom joint member 8 is forked to form two bearing limbs 9 and 10 with aligned bearing holes 11, by means of which the outer boom member 2 is borne on a pivot shaft in the upper carriage of a crane vehicle. On the outer boom member 2 the piston rod of the luffing cylinder is also pivoted in a manner not illustrated here.

The piston rod 12 of the single stage hydraulic piston and cylinder unit 7 is provided at its inner end with a head piece 13, by means of which it is pivoted on the boom joint member 8.

The cylinder 18 of the piston and cylinder unit 7 is provided at the piston rod end with a collar 19, which on opposite sides has cylinder holes in the longitudinal median plane, and pistons coupling bolts 20 and 21 are located in such holes. At the inner ends thereof the telescoping boom members 3 through 6 bear welded-on, frame-like terminal members 22 through 25, which are located on opposite sides and symmetrically with respect to the luffing plane of the telescoping boom 1. The terminal members are provided with bell-like bushings 26, which constitute receiving means for the coupling bolts 20 and 21. In the retracted condition of the telescoping boom members 3 through 6 illustrated in FIGS. 1 through 3, the center lines of the holes of the receiving means are at an equal distance from one another. To this extent the telescoping boom is the same as the telescoping boom in accordance with European patent publication 0 476 225 A2.

Centrally in their upper walls, the telescoping boom members 3 through 6 have spring-loaded locking bolts 30–33, respectively, at their ends. These locking bolts are able to run longitudinally in holes in the outer walls of the telescoping boom members and are biased by compression springs 34 in the direction of extension, which springs at one end bear against collars 35 forming abutments and at the other end in stepped recesses in covers 36, which terminate in a housing-like cage for the locking bolts. The collars 35 of the locking bolts bear against the inner edges of the holes in the outer walls of the extensible boom members. At their inner ends the locking bolts 30 through 33 centrally bear shanks 37, which at their innermost ends are provided with circular disks 38. The disks 38 of the locking bolts are located, as shown in FIG. 3, in a common plane.

Figure 6:
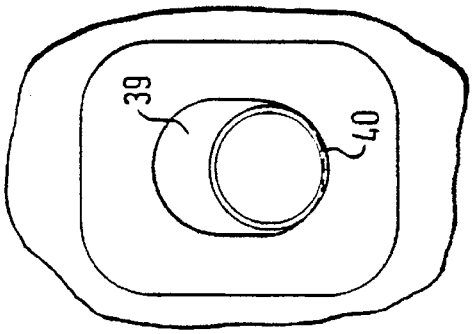
FIG. 6 is a plan view of a locking device.

At their inner ends and outer ends the boom members 2 through 5 possess holes 39, into which there fit the locking bolts 30 through 33 for a locking action in an extended or retracted position. The locking bolts are provided at their free ends, which extend through the locking holes 39, with annular beads 40 to prevent accidental release. The outer locking holes 39, as shown in FIG. 6 as representative of holes 39 at the inner and outer ends of the boom members, are designed in the form of slots extending in the axial direction of the crane. In the locked condition of the extended boom member the locking bolts bear against the inner ends of the slots 39 so that the annular beads 40 fit in the fashion indicated in FIG. 6 around and beyond the lower edge of the locking hole 39 to prevent accidental release by a downward force on the head of the locking bolt.

In the part adjacent to its terminating collar for the piston rod 12, the telescoping cylinder 18 is provided (at a right angle to the horizontal plane, wherein the cylinder holes are located with the coupling bolts 20 and 21) with a further piston and cylinder unit 50 on its top side, the piston 51 of such piston and cylinder unit being provided with a trough-like recess 52 at its upper free end, such recess extending in the axial direction. This trough-like recess is U-like shape in cross section, ribs 53 being provided at the upper ends of the limbs to define a gap between them, through which the shank 37 of the locking bolts 30 through 33 may fit. If the collar of the cylinder 18 is moved with the piston and cylinder unit 50 as far as the individual locking bolts 30 through 33, the respective circular disk 38 will be within the trough-like recess 52 in the manner indicated in FIGS. 4 and 5 so that the locking bolts 30 through 33 are coupled with the piston and cylinder unit 50. By retraction of the piston 51 the locking bolts may be moved into their unlocked position. The compression spring 34 will thereby be compressed to release the locking bolts from their respective locking holes.

In order to be able to move the collar, provided with the piston and cylinder unit 50, of the telescoping cylinder 18 exactly into engagement with the circular disk 38 coupling members of the locking bolts 30 through 33, a reflection type photoelectric detector 56 is provided, which senses marks on the inner wall surfaces of the telescoping boom members.

Figure 4:
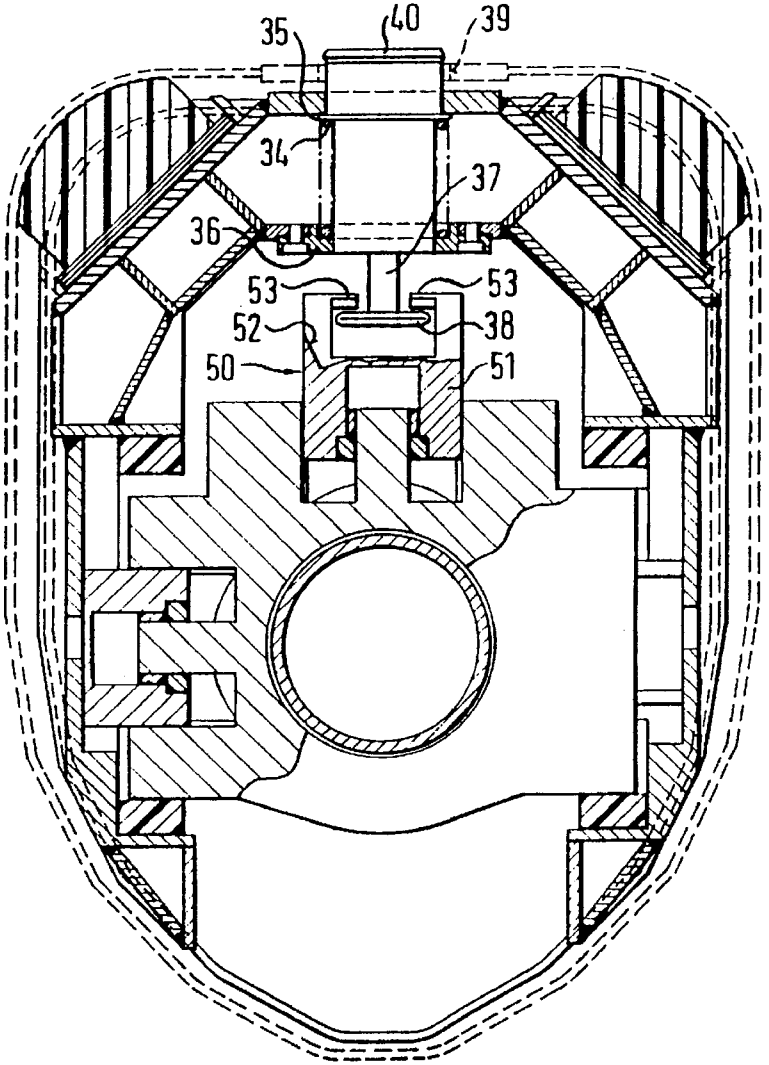
FIG. 4 is a cross section taken through the telescoping boom.
Figure 5:
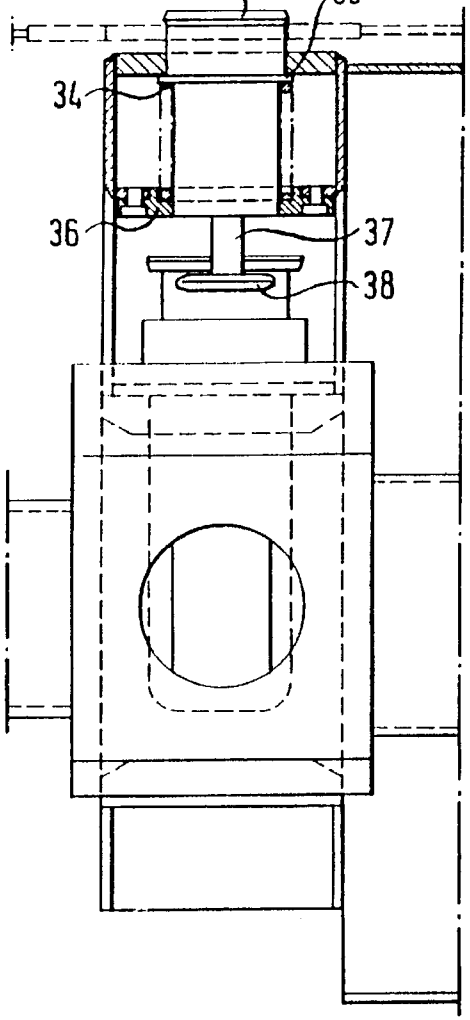
FIG. 5 is a lateral elevation of the coupling device.

FIG. 4 shows a section taken through two telescoping boom members locked together in the extended position. For the extension and retraction of the individual telescoping boom members, the collar-like edge of the telescoping cylinder 18 is brought to the level of the corresponding terminal part of the telescoping boom member and positioned there using the photoelectric detector 56. Following this the two lateral coupling bolts 20 and 21 are extended. Using proximity switches installed in the crane on the equipment in the lateral cylinders extending the bolts 20 and 21, it is possible to ensure that both bolts are completely extended and locked in the holes in the telescoping boom member. It is only after such locking that the piston and cylinder unit 50 is operated so that the piston 51 is retracted and the locking action on the next telescoping boom member may be released.

The inner telescoping boom is now driven as far as the desired length of extension. In this position the piston 51 is moved outward so that the extended telescoping boom member is locked to the telescoping boom member encompassing it by fitting the locking bolt in the locking hole. By means of limit switches fitted in the piston and cylinder unit 50 it is possible to ensure that the respective locking bolt has been moved into position. It is only when such locking of the telescoping boom members has taken place that it is possible to draw in the two lateral bolts 20 and 21 using the respective cylinders. Following this the telescoping cylinder 18 is retracted as far as the terminal member of the next telescoping boom member in the manner described to lock it to the same. The extension of the next telescoping boom member is performed in a like manner. The retraction of the individual telescoping boom member is performed in the reverse order.

Having described the invention, many modifications thereto will become apparent to those skilled in the art to which it pertains without deviation from the spirit of the invention as defined by the scope of the appended claims.

We claim:

1. A travel crane comprising:

a telescoping boom including a plurality of individual telescoping members adapted to be extended and retracted, a first piston and cylinder unit for extension and retraction of said plurality of individual telescoping members by coupling bolts provided with the first piston and cylinder unit, the coupling bolts being couplable with receiving means provided with the respective telescoping members, spring-loaded locking bolts for holding said plurality of individual telescoping members in locked positions, a piston rod of said first piston and cylinder unit terminating at an inner end of an outermost boom member of said plurality of individual telescoping members, an entraining device arranged adjacent to a piston rod end of a cylinder of said first piston and cylinder unit, each of said plurality of individual telescoping members having a single one of said locking bolts at an inner end with a spring of each of said locking bolts being biased in a direction of radial extension of said locking bolts extending from said first piston and cylinder unit into a locking hole located at an inner end or adjacent to an outer end of one of said plurality of individual boom members surrounding another one of said plurality of individual telescoping members, each of said locking bolts including a coupling member, said entraining member including a second piston and cylinder unit arranged radially on said piston rod end of said cylinder of said first piston and cylinder unit with said coupling member of each of said locking bolts being engageable with one of a piston and a cylinder of said second piston and cylinder unit for moving said locking bolt radially inwardly with respect to said first piston and cylinder unit to release said individual telescoping members for movement in an axial direction of said telescoping boom, positioning means for determining a correct relative positioning of two of said telescoping members to a coupling position, and a corresponding locking hole for said single locking bolt the individual telescoping members, said coupling bolts provided with the first piston and cylinder unit being arranged perpendicularly to the single locking bolt and the corresponding locking hole of the respective individual telescoping members.

2. The crane as claimed in claim 1, wherein said coupling member includes a circular disk connected by a shank and a mating coupling member of said second piston and cylinder unit is a piece of section material extending in the axial direction and having a trough-like portion with a U-shaped cross section, which at a free end of its limbs is provided with inwardly directed ribs, the ribs defining a gap between them whose width is at least a diameter of said shank and said limbs have a clearance distance between them which is at least a diameter of said circular disk.

3. The crane as claimed in claim 1, wherein said positioning means includes reflection type photoelectric detector means arranged on the cylinder for scanning marks on the telescoping members.

4. The crane as claimed in claim 1, wherein the telescoping members comprise section material having top sides formed by U-like members having limbs welded to edges of lower curved shells.

5. A traveling crane comprising:

a boom including a plurality of individual telescoping members, locking bolts biased to hold said telescoping members in locked positions, a first piston and cylinder unit pivotally mounted on a boom joint member for extending and retracting said telescoping members by coupling bolts provided with the first piston and cylinder unit, the coupling bolts being couplable with receiving means provided with the respective telescoping members, each of said plurality of individual telescoping members having a single one of said locking bolts at an inner end with a spring of each of said locking bolts being biased in a direction of radial extension of said locking bolts extending from said first piston and cylinder unit into a locking hole located at an inner end or adjacent to an outer end of one of said plurality of individual boom members surrounding another one of said plurality of individual boom members, a release device arranged on a piston rod of said first piston and cylinder unit, said release device including a second piston and cylinder unit for engaging said locking bolts and releasing said locking bolts from said locked positions to allow said telescoping members to move relative to each other by said first piston and cylinder unit and to release said locking bolts to relock said telescoping members, and a corresponding locking hole for said single locking bolt of each telescoping member being located in a top side of a surrounding boom member said coupling bolts provided with the first piston and cylinder unit being arranged perpendicularly to the single locking bolt and the corresponding locking hole of the respective individual telescoping members.

6. A traveling crane as claimed in claim 5, wherein said locking bolts each include a head mounted on a shank with the shank terminating in a circular disk.

7. A traveling crane as claimed in claim 6, wherein said release device includes a trough-like recess for receipt of said shank and said circular disk of said locking bolt.

8. A traveling crane as claimed in claim 6, wherein said head includes an annular bead to engage a sidewall of a hole through which said head projects.

* * * * *